US007926881B1

(12) United States Patent
Youreman

(10) Patent No.: US 7,926,881 B1
(45) Date of Patent: Apr. 19, 2011

(54) SUPPORT FOR A SEATED INFANT

(76) Inventor: Neva Youreman, Kalispell, MT (US)

( * ) Notice: Subject to any disclaimer, the term of this patent is extended or adjusted under 35 U.S.C. 154(b) by 0 days.

(21) Appl. No.: 11/715,513

(22) Filed: Mar. 8, 2007

Related U.S. Application Data

(60) Provisional application No. 60/780,117, filed on Mar. 8, 2006.

(51) Int. Cl.
*A47C 31/00* (2006.01)
*A47D 15/00* (2006.01)

(52) U.S. Cl. .... 297/464; 297/467; 297/485; 297/230.12

(58) Field of Classification Search ..... 297/468, 297/464, 467, 469, 188.06, 484, 485, 230.12, 297/230.14; 128/869, 874
See application file for complete search history.

(56) References Cited

U.S. PATENT DOCUMENTS 3,840,916 A * 10/1974 Jennings ..... 5/655
4,568,125 A 2/1986 Sckolnik
4,621,004 A 11/1986 Madsen
4,637,629 A * 1/1987 Cummings ..... 280/801.1
4,861,109 A 8/1989 Leach
4,871,210 A 10/1989 Alexander et al.
5,076,264 A * 12/1991 Lonardo et al. ..... 602/19
5,330,250 A 7/1994 Reyes
5,354,121 A 10/1994 Allum
5,551,749 A 9/1996 Reher et al.
5,700,059 A * 12/1997 Moscot ..... 297/452.17
5,713,630 A * 2/1998 Kvalvik ..... 297/467 X
5,915,789 A * 6/1999 Ponce De Leon, III ..... 297/484
5,918,933 A 7/1999 Hutchinson et al.
5,964,506 A * 10/1999 Coates et al. ..... 297/467 X
6,053,580 A * 4/2000 White, Sr. ..... 297/467
6,095,613 A * 8/2000 Ostrander et al. ..... 297/467
6,095,614 A * 8/2000 Canna et al. ..... 297/468
6,224,152 B1 5/2001 Hughes et al.
6,415,969 B1 * 7/2002 Higuchi ..... 224/160
6,601,916 B1 * 8/2003 Kamiki ..... 297/250.1
6,902,193 B2 * 6/2005 Kim et al. ..... 280/801.1
7,356,861 B1 * 4/2008 Pagano ..... 5/655
2004/0026966 A1 * 2/2004 Albersen ..... 297/188.06 X
2006/0138851 A1 * 6/2006 Stoll ..... 297/464

* cited by examiner

*Primary Examiner* — Anthony D Barfield
(74) *Attorney, Agent, or Firm* — Jean Kyle

(57) ABSTRACT

A support braces and secures an infant or small child in a seated position. A rigid padded upright back is flanked by a pair of rigid padded side wings. A belt encircles the back and wings drawing the wings toward the back to surround the child. The wings reach just under the armpits of the small child providing support to the torso and allowing even those children not old enough to sit up on their own to attain a seated position. A padded strap, attached to the bottom of the upright back runs between the child's legs and is also secured with the belt. When secured to a high chair by the belt, the support braces the child in a seated position and prevents the child from slipping from the high chair or from climbing out of the chair.

10 Claims, 4 Drawing Sheets

SUPPORT FOR A SEATED INFANT

CROSS-REFERENCE TO RELATED APPLICATIONS

This application claims the benefits of U.S. Provisional Application No. 60/780,117, filed Mar. 8, 2006, the disclosure of which is hereby incorporated by reference in its entirety including all figures, tables and drawings.

BACKGROUND OF THE INVENTION

A number of restraints for infants seated in high chairs and car seats have been described. The restraints are often padded to offer a soft surface for the seated child (U.S. Pat. Nos. 4,568,125; 4,621,004; 4,861,109; 4,871,210; 5,330,250; 5,354,121; and 5,918,933). Various straps and belts are attached to the padded surface to secure the restraint to the chair and the child to the restraint. Few of these restraints however assist the child in attaining and maintaining a seated position (U.S. Pat. Nos. 5,551,749; and 6,224,152 B1).

A need therefore remains for a restraint/support device that supports a young child in a seated position and prevents the child from sliding from the chair.

All patents, patent applications, provisional patent applications and publications referred to or cited herein, are incorporated by reference in their entirety to the extent they are not inconsistent with the teachings of the specification.

SUMMARY OF THE INVENTION

The subject invention involves a support to help infants and small children attain and maintain a seated position. The support has an upright rigid back flanked by a pair of rigid side wings. A belt encircles the back of the support and the wings to draw the wings around the child supporting the child's torso to help the child sit up. The wings fit comfortably under the child's armpits. The belt can also secure the support to the chair in which it is placed. A padded strap attached to the bottom of the upright back runs between the child's legs and is likewise secured by the belt. The strap prevents the child from being able to slide out of the support.

DETAILED DESCRIPTION OF THE INVENTION

Figure 1:
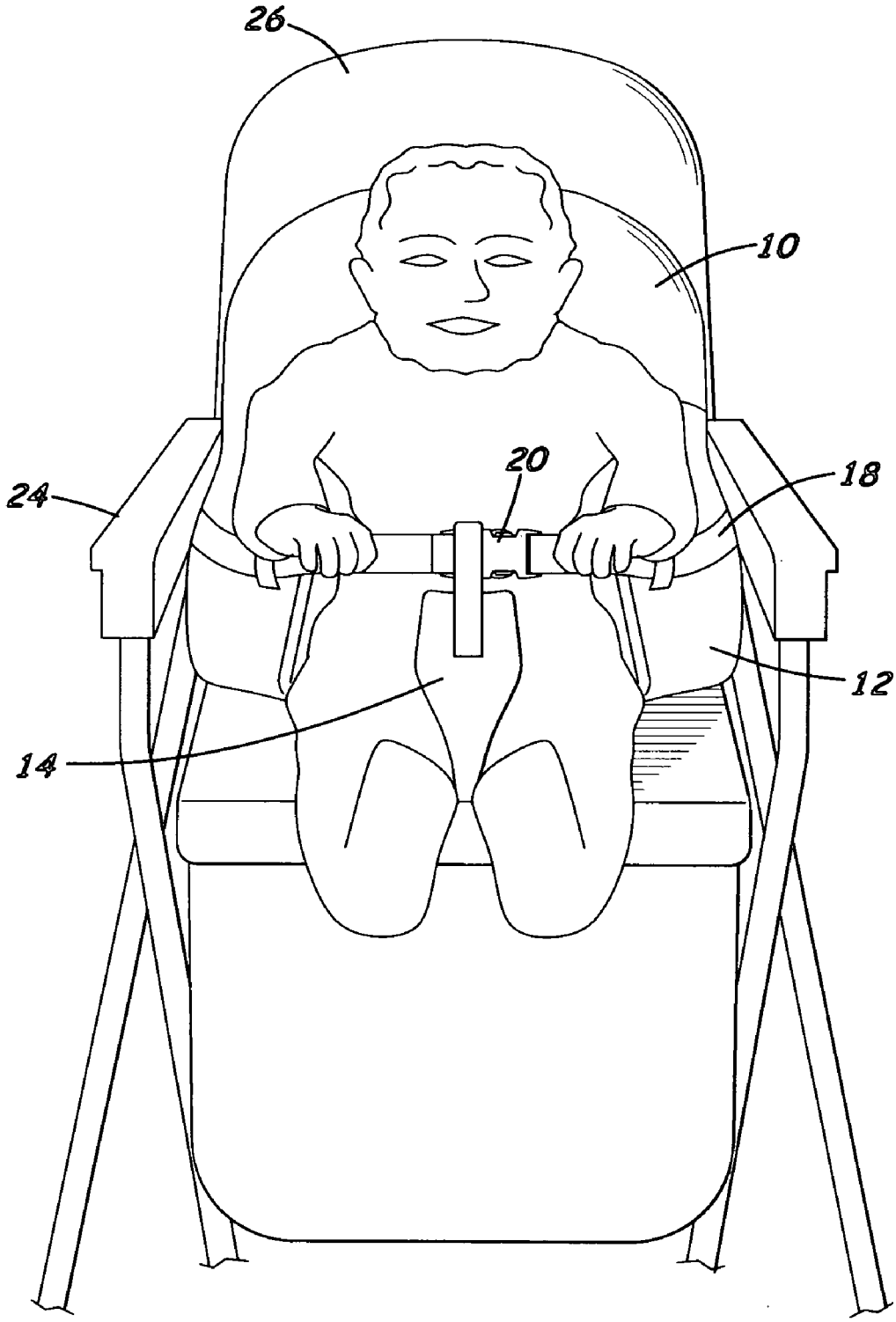
FIG. 1 is an environmental view of a preferred embodiment of the support of the subject invention holding an infant and in place in a high chair.
Figure 2:
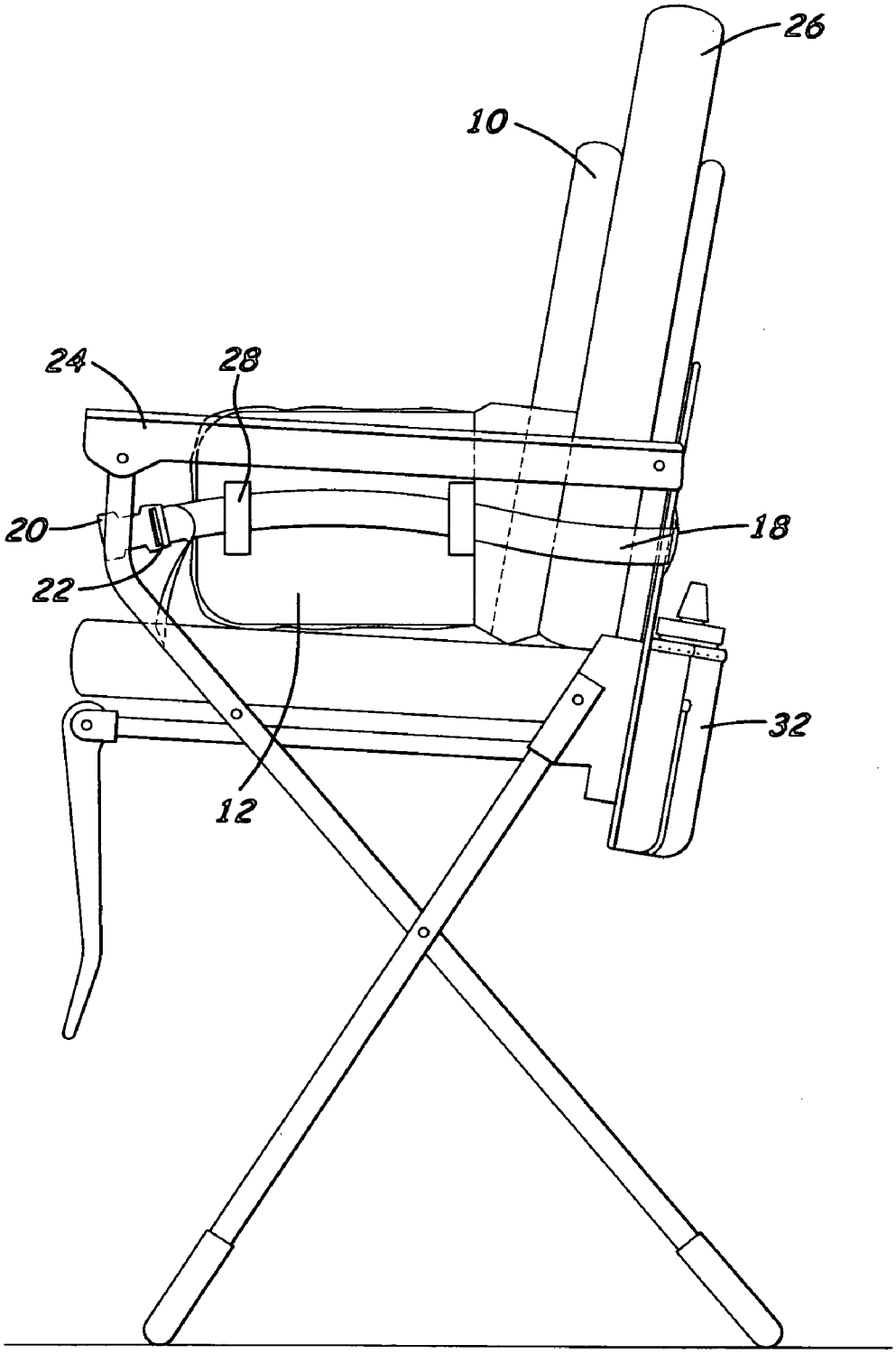
FIG. 2 is a side view of the environmental view shown in FIG. 1 with the infant removed.

The support of the subject invention allows an infant or small child to attain and maintain a seated position. An upright back and side wings surround the child to provide support to the torso of the child in a seated position. The back and wings are pulled around the child by a single belt. The belt further captures a strap, attached to the back of the support, which runs between the legs of the child. The support can be secured to a chair also by the belt. In the exemplified embodiment, the support is shown in a high chair (FIGS. 1 and 2). The support used in a high chair as shown prevents a child from climbing out of the chair since the child is unable to twist and pull their legs from the strap. It is important to note however that the support can be used with a variety of chairs and seats.

Figure 3:
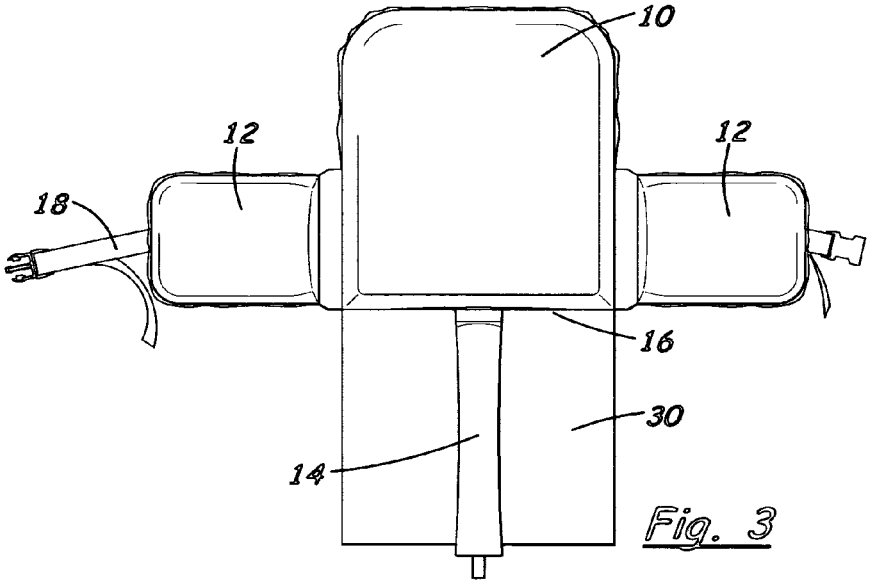
FIG. 3 is a front elevational view of a preferred embodiment of the support of the subject invention.
Figure 6:
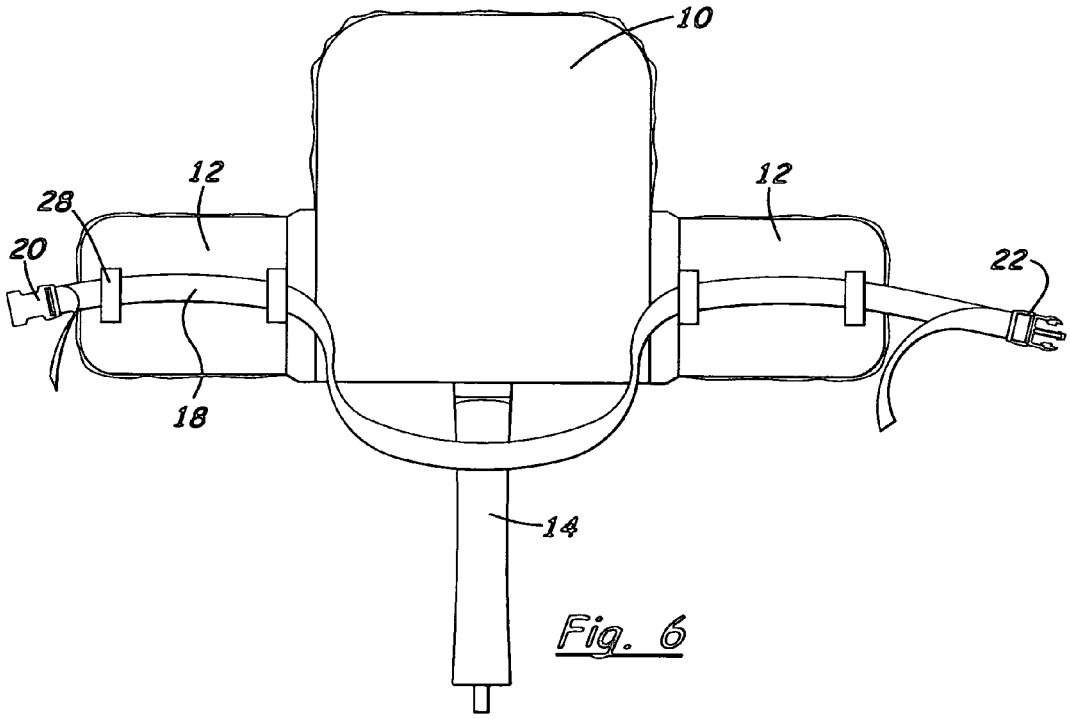
FIG. 6 is a back elevational view of another preferred embodiment of the support of the subject invention.

The support comprises a rigid, upright back 10 flanked by a pair of rigid side wings 12 (FIG. 1). The back is tall enough to support the torso of an infant or small child seated next to it and is preferably high enough to provide some support for the head of the child. The width of the back can vary but should cover about the width of the back of the seated child. The wings 12 are tall enough to reach under the armpits of the child and to provide support to the torso. The wings are likewise long enough so when pulled around the child to provide lateral support to the torso. A strap 14 attaches to the bottom 16 of the upright back (FIGS. 3 and 6) as a means to retain the infant in the support. The strap 14 extends between the seated infant's legs and is captured by a belt 18 (FIG. 1). The strap must be long enough to extend under the child and be captured by the belt. The strap prevents the infant from sliding out of the support. One skilled in the art will recognize that there are other means to prevent the child from sliding out of the support, including, but not limited to, a harness through which the infant's legs can extend.

Figure 4:
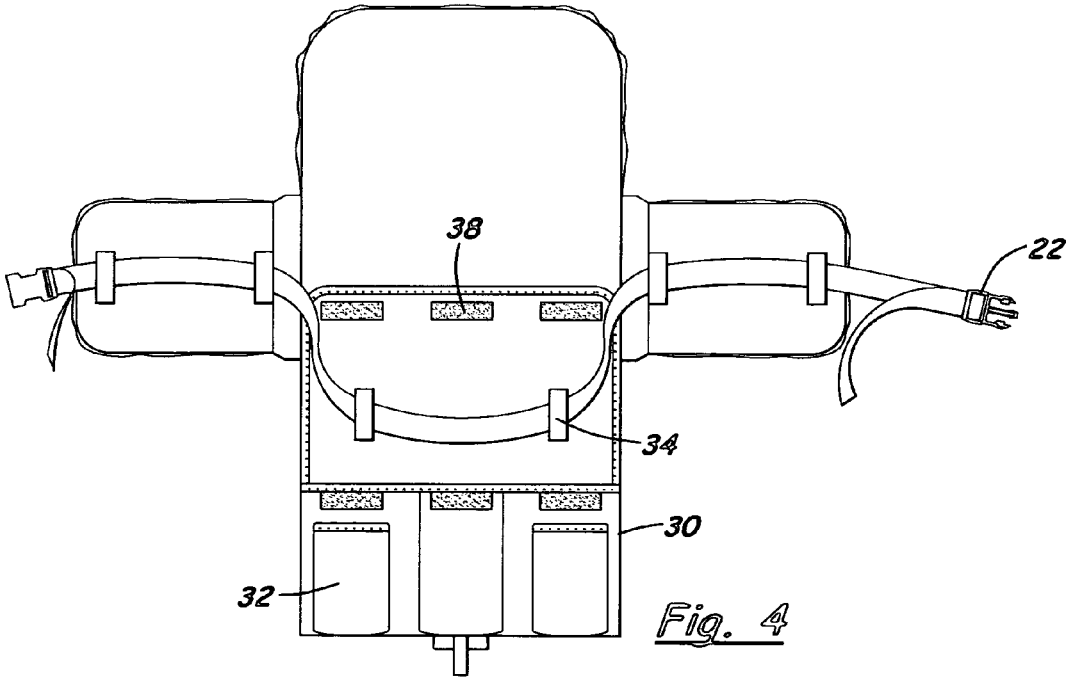
FIG. 4 is a back elevational view of a preferred embodiment of the support of the subject invention including an open back storage pouch.

A single belt 18 encircles the back 10 to draw the wings 12 in to surround a child seated against the back (FIG. 4). The belt has an easy to operate buckle 20. Belt tightening means 22 allow the support to be adjusted to fit a variety of infants insuring proper fit and safe support. The belt can be further used to attach the support to a chair 24. When used to attach the support to a chair, the belt must be of sufficient length to surround a chair back 26 as well as the child within the support. Although in the exemplified embodiment a single belt is used to attach the support to the chair and the child to the support, one should be aware that more than a single element can be used for these tasks. To prevent the belt from slipping after it is tightened, the belt is slidably anchored 28 to the wings. In a preferred embodiment, the belt is simple nylon strapping. Nylon strapping is durable, flexible and has no sharp edges. Other, material can be used for the belt however as long as the material is strong and provides no threat of injury to the child.

The back 10 and side wings 12 are rigid, padded components and can, although it is not necessary, have about the same rigidity. In the exemplified embodiment, the strap, back and wings are cut from a rigid plastic sheet. The plastic sheet material is lightweight and allows some flexibility. The back and wings must have sufficient rigidity to support the torso of the seated individual. The strap must have some flexibility to wrap under the infant to meet the belt. Preferably, all components are padded. In the exemplified embodiment, the components are padded with one inch foam and then covered with a soft vinyl. The vinyl is durable and washable allowing the support to be easily wiped clean.

Figure 5:
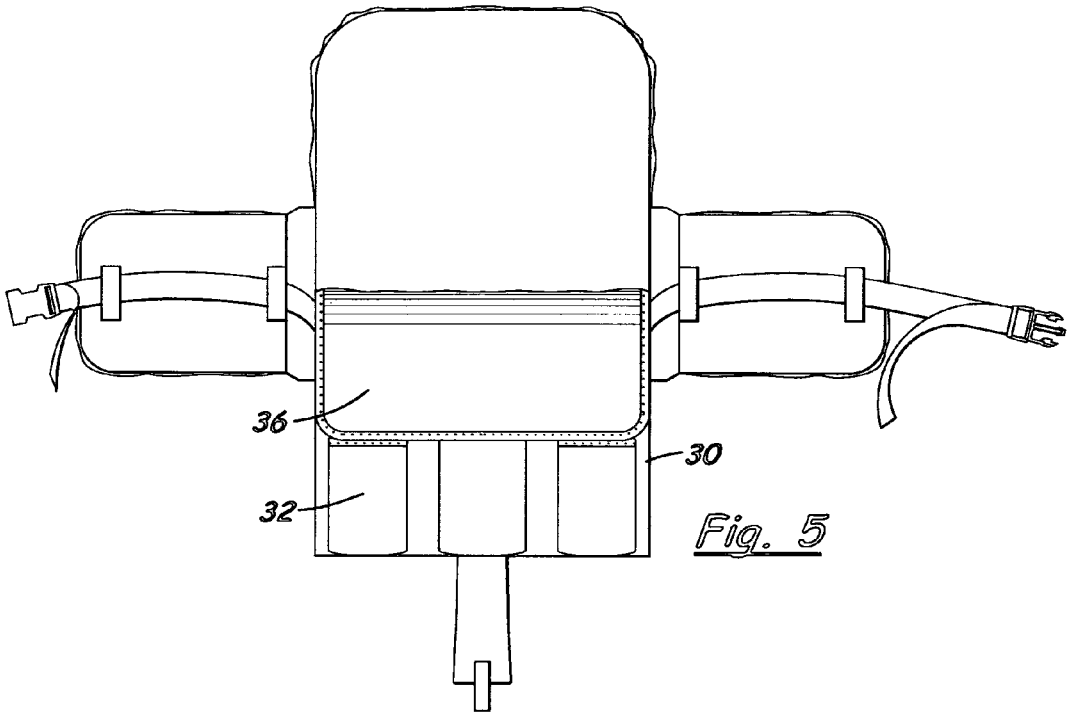
FIG. 5 shows the preferred embodiment in FIG. 4 with the storage pouch closed.

In a preferred embodiment, a storage pouch 30 is included that hangs from the belt behind the chair containing the support (FIGS. 4 and 5). The pouch has at least one pocket 32 to hold items useful to the care giver. In the exemplified embodiment, the pouch hangs from loops 34 on the belt and has a variety of pockets sized to fit necessities for an infant such as a bottle, diapers, wipes and a pacifier. The pouch can have a flap 36 to cover the stored items. The flap additionally can have a catch 38 to secure the item within the pouch. In the exemplified embodiment, the pouch is secured by hook and loop fasteners. The pouch is preferably made of a durable material that is easy to clean. In the exemplified embodiment, the pouch is made of a nylon material that can be machine washed.

All components of the subject invention should be constructed of durable materials safe and appropriate for the purpose. Preferably, the materials should be tested for fire safety. Additionally, it is preferred, but not required, that many of the materials be washable to accommodate use by children. For example, vinyl was chosen to cover the support because it can be wiped clean. Vinyl material also offers bright, vibrant colors pleasing to a child. Although the subject device is described and shown to support an infant who may not yet be strong enough to sit up, the device can be adjusted and used to support anyone who may need assistance in attaining and maintaining a seated position.

In a particularly preferred embodiment, a bag (not shown) is provided to hold the pouch, and support device. The bag insures that all parts of the support are stored together and allows the support to be easily taken to different locations where it is needed, for example, to a restaurant. The bag must be large enough to hold at least the support and should be made of strong, durable fabric that is easy to clean.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A seat-less support to enable a person to attain and maintain a seated position while seated in a chair, comprising:

a rigid, upright back having a top edge, a bottom edge, opposing side edges, a front and a rear;

rigid wings extending from and moveably attached to each side edge of the back;

at least one strap extending from the bottom edge of the upright back;

a belt encircling the back, the wings, a back of the chair and capturing the at least one strap;

wherein the belt draws the back and wings around a torso of the person to support and allow the person to attain and maintain a seated position in the chair.

2. The seat-less support of claim 1, wherein said strap has an end attached to said bottom edge of said upright back and another end distal said bottom edge of said back.

3. The seat-less support of claim 1, wherein said belt is adjustable.

4. The seat-less support of claim 1, further comprising a storage pouch.

5. The seat-less support of claim 4, wherein said storage pouch is removably attached to said back.

6. The seat-less support of claim 4, wherein said storage pouch is removably attached to said rear of said upright back.

7. The seat-less support of claim 4, wherein said storage pouch has at least one pocket.

8. The seat-less support of claim 1, wherein at least one of said upright back, said wings and said retaining means are padded.

9. The seat-less support of claim 1, wherein said back, said wings and said retaining means are padded.

10. The seat-less support of claim 1, wherein said support is constructed of washable material.

* * * * *